United States Patent [19]

Bradley

[11] 4,135,300

[45] Jan. 23, 1979

[54] LAMINATION TRIMMING DEVICE

[75] Inventor: David D. Bradley, Mundelein, Ill.

[73] Assignee: General Binding Corporation, Northbrook, Ill.

[21] Appl. No.: 848,735

[22] Filed: Nov. 4, 1977

[51] Int. Cl.[2] ..... B26B 29/00

[52] U.S. Cl. ..... 30/293; 30/294

[58] Field of Search ..... 30/294, 293, 289, 286, 30/287, 288

[56] References Cited

U.S. PATENT DOCUMENTS

| | | | |
|---|---|---|---|
| 635,495 | 10/1899 | Markham | 30/289 |
| 820,148 | 5/1906 | Smith | 30/288 |
| 944,019 | 12/1909 | Conrow | 30/293 |
| 1,032,865 | 7/1912 | Sinnott | 30/289 |
| 1,463,312 | 7/1923 | Dillinger | 30/293 |
| 1,472,269 | 10/1923 | Grimmer | 30/293 X |
| 2,067,986 | 1/1937 | Schmidt | 30/287 X |
| 2,120,960 | 6/1938 | Arthur | 30/293 |
| 2,187,590 | 1/1940 | Lurie | 30/294 X |
| 2,204,763 | 6/1940 | Maximilian | 30/289 |
| 2,282,062 | 5/1942 | Jewett | 30/294 |
| 2,411,927 | 12/1946 | Luke | 30/293 |
| 2,582,677 | 1/1952 | Burnett | 30/287 X |
| 3,118,228 | 1/1964 | Adams | 30/294 |

FOREIGN PATENT DOCUMENTS

| | | | |
|---|---|---|---|
| 1,485,654 | 5/1967 | France | 30/289 |
| 1,938 of | 1908 | United Kingdom | 30/289 |

*Primary Examiner*—Al Lawrence Smith
*Assistant Examiner*—J. T. Zatarga
*Attorney, Agent, or Firm*—Hill, Gross, Simpson, Van Santen, Steadman, Chiara & Simpson

[57] ABSTRACT

A lamination trimming device is disclosed for trimming excess laminating film along edges of a laminated card or sheet product. The trimming is performed such that a border of sealed laminating film remains along edges of the product. The device includes lower and upper guide members between which the laminating film is retained. A cutting blade is positioned above an upper guide member for trimming off the excess film and a deflecting surface is provided on a lower guide member for guiding the device along edges of the laminated product and for deflecting the excess laminated film to be trimmed. Both straight and curved surfaces may be trimmed with the device disclosed herein.

15 Claims, 7 Drawing Figures

LAMINATION TRIMMING DEVICE

BACKGROUND OF THE INVENTION

1. Field of the Invention

This invention relates to trimming devices and more particularly to trimming devices for laminated film products.

2. Description of the Prior Art

Presently, a problem exists with respect to trimming off excess laminating film from laminated documents such as sheets or identification cards. Such products are produced by laminating machines which, after the product has been laminated, leave an excess film which must be trimmed on all sides of the product. An accurate "overlap" of film is desirable to create an edge seal. Laminating machines which employ cross slitters and side slitters are presently known. Side slitters typically comprise razor blades positioned to trim the excess film from straight edges and parallel edges along sides of the product relative to forward movement through the machine. These trimmers are only as accurate as the feeding of the sheets into the laminator. Also, as the sheet width varies, the side slitters must be adjusted to accommodate this variation. Cross slitters are employed for the purpose of parting the web of film from the machine after a series of sheets of cards have been laminated. Such cross slitters consist of cutting blades which cut transverse to the direction of movement through the machine.

If scissors are used to obtain an edge border of sealed film around the product accuracy is sacrificed.

In short, until now there has not been an accurate, swift method of trimming excess laminating film from sheet material.

SUMMARY OF THE INVENTION

It is an object of this invention to provide a trimming device which will trim excess film from sheet material while maintaining an accurate edge seal border.

It is another object of this invention to provide a trimming device which will maintain a sealed border accurate to within a few thousandths of an inch around the product.

It is a further object of this invention to provide a trimming device which can be easily adjusted, without the use of tools, to produce various border seal widths.

It is another object of this invention to provide a trimming device wherein many thousands of feet of laminating film may be trimmed without the device becoming dull.

It is another object of this invention to provide a trimming device which may safely operated and without the possibility of cutting the operator.

It is a further object of this invention to provide a trimming device which is compact in size, inexpensive to produce, simple to operate, and which can be readily manufactured by simple techniques.

According to the invention, a lamination trimming device for trimming excess laminating film along edges of a laminated product is provided such that a border of sealed laminating film remains along the product edges. The device includes lower and upper guide members, a cutting member above the guide member for trimming off the excess film, and a deflecting member on the lower guide member for guiding the device along edges of the laminated product and for deflecting the excess laminated film to be trimmed.

DESCRIPTION OF THE PREFERRED EMBODIMENTS

Figure 1:
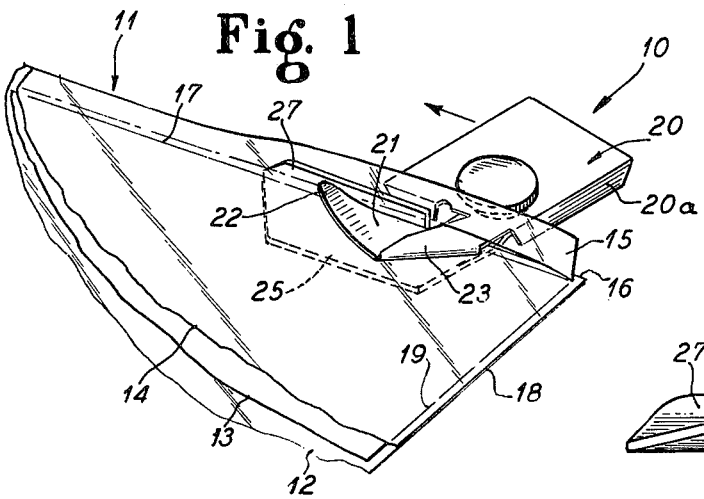
FIG. 1 illustrates a perspective view of the lamination trimming device illustrating the trimming of excess laminating film along an edge of a laminated product.
Figure 3:
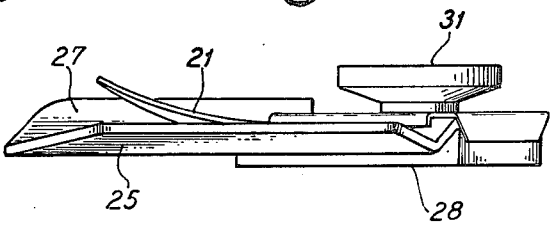
FIG. 3 is a side view of the device of FIG. 1.

As shown in FIG. 1, a lamination trimming device generally shown at 10 may be employed to remove an excess film strip 15 of a laminated sheet or card product generally shown at 11. Typically, the sheet or card product consists of 13 to 110 pound index stock.

A card or sheet 13 has a lower laminating film 12 and an upper laminating film 14 applied over upper and lower surfaces thereof. The films are typically 0.001 to 0.003 inches thick. These films may be polyester/-polyethylene composite films or polyethylene/paper composite films. Other types of film may also be employed.

The upper and lower films are joined together at peripheral edges of the card 13 so as to form a sealed film edge 16 or 18. These film edges 16 or 18 are respectively spaced a predetermined distance from the sheet or card edge 17 or 19. This spacing or width of the sealed film border may be accurately controlled within a few thousandths of an inch with the trimming device 10 of this invention.

Figure 2:
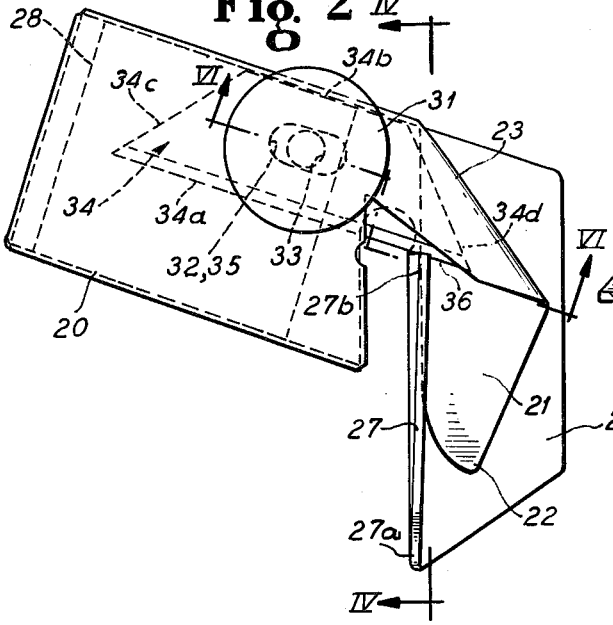
FIG. 2 is a plan view of the device of FIG. 1.
Figure 4:
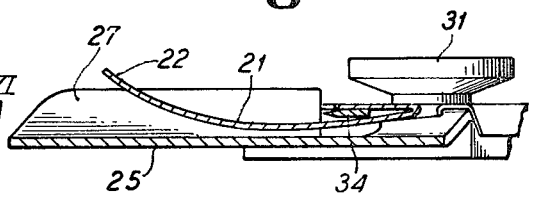
FIG. 4 is a cross-sectional view taken along line IV—IV of FIG. 2.

Referring now to FIGS. 1 through 7, a blade cover member 20 having depending skirts **20*a* is positioned over a blade 34 as most clearly shown in FIG. 2. Attached to the blade cover member 20 is a protruding upper guide member 21 having a ski-shaped tip or portion 22 which is upwardly turned with respect to a lower guide member 25. A fold portion 23 is positioned between the upper guide member 21 and cover member 20. This fold portion serves to receive a leading edge 34*d* of the blade 34 as most clearly shown in FIG. 2**.

The blade cover member 20 overlies the blade 34 and a main body member or blade supporting member 24. A lower guide member 25 protrudes from the main body 24 (FIG. 6) and has an upper surface which is substantially parallel to the planar portions of the upper guide member 21.

Figure 6:
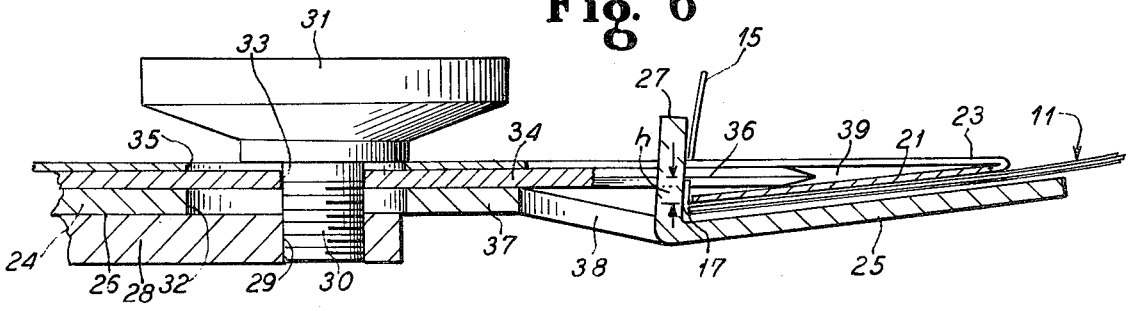
FIG. 6 is a cross-sectional view taken along line VI—VI of FIG. 2.

As shown most clearly in FIGS. 1 and 6, an edge guide member 27 formed by folding an edge of the lower guide member 25 upwardly is provided adjacent to an edge of the upper guide member 21. The edge guide member 27 has a leading portion **27*a* which is substantially 90° with respect to the lower guide member 25 as shown in FIG. 2. Alternately, an obtuse angle may be formed at this portion of the guide member 27. An acute angle is formed by a portion of the guide member at 27*b* adjacent a cutting edge 36 of the blade 35. By forming the guide member in this fashion, the excess lamination film to be trimmed is increasingly bent with respect to the laminating sheet 13 at greater angles as it approaches the exposed cutting portion 36 of the blade 34**.

A slidable bolt retaining member 28 of preferably rectangular shape slides along a lower surface 26 of the main body member 24 as shown in FIG. 6. Member 28 has a threaded apperture 29 which serves to receive a bolt 30. The bolt 30 in combination with the finger knob 31 compresses the overall combination of elements for the laminating trimming device together. Specifically, the bolt 30 passes through an oblong aperture 35 in the blade cover member 20, through an aperture 33 in the blade 34 of approximately the same dimensions as the bolt 30; through an oblong aperture 32 in the blade support or main body member 24; and thereafter into the threaded portion 29 of the bolt retainer member 28.

As shown most clearly in FIG. 2, the blade 34 has a cutting edge 34*a*, an opposite guide edge 34*b*, and trailing and leading side edges 34*c* and *d*. The overall shape of the blade is preferably that of a trapezoid. The exposed cutting portion of the blade 36 is positioned at the end of the edge guide or deflector member 27 at 27*b*.

Figure 7:
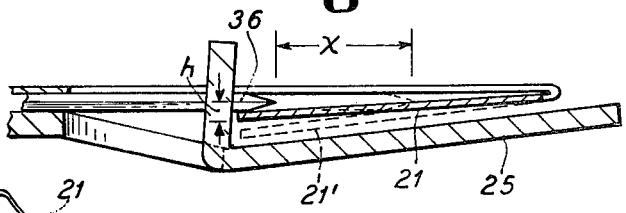
FIG. 7 is a fragmentary cross-sectional view illustrating in detail movement of a cutting blade within the device to permit adjustment of the width of the border seal around the laminated product.
Figure 5:
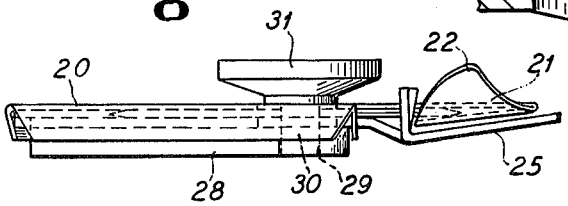
FIG. 5 is a front view of the device of FIG. 1.

With reference to FIGS. 6 and 7 the adjustment of the border width of the sealed film around the card or sheet 13 will now be described. An extension portion 37 of the main body 24 connects with a transverse transition portion 38 to which is connected the lower guide member 25. The lower guide member 25 is angled and at a lower level than the main body portion 26 by use of this transition portion 38. The fold 23 has a sheath-like area 39 formed therein which receives the leading edge 34*d* of the blade 34. As the blade 34 is slid into this sheath area 39, the upper guide member 21 is biased downwardly towards the lower guide member 25. As shown in FIG. 6, as an excess strip of film 15 is being removed from the laminated product 11, the laminated product 11 is pulled up against the under surface of the upper guide member 21. Consequently, the position of the upper guide member 21 determines a distance "*h*" at which the blade 34 cuts the sealed film. This distance *h* then corresponds to the border width of the seal around the laminated product 11. As shown in FIG. 7, the insertion distance "*x*" of the blade 34 is related to the change in height "*h*" of the upper guide member 21 such that the upper guide member may assume a new position 21'.

In order to slide the blade 34, the knob 31 connected to the bolt 30 is turned so that the entire structure becomes relaxed such that compression forces on the blade 34 are removed. By movement of the knob 31 along the oblong slots 32 and 35 the blade may be moved toward the sheet-like area 39.

Operation of the trimming device of this invention will now be described. The device 10 is advanced toward the edge 18 of the laminated sheet 11. The deflector or edge guide member 27 deflects the excess film strip 15 such that approximately a 90° bend is created. The stiffer edge 17 as shown in FIG. 1 of the product 11 then aligns itself with the deflector and edge guide member 27. The ski-like portion 22 of the upper guide member 21 together with the planar portions of the upper guide member 21 hold the sheet downwardly against the lower guide member, causing the sheet to remain parallel to the trimming knife blade 34.

As the device is advanced forwardly, the knife blade shears free the excess film strip 15 at a point dependent upon the height "*h*" so as to establish a predetermined border width of sealed film along the edge 17. After the shearing action is complete, the sheared film edge 16 relaxes from the 90° position to the original parallel position. The excess film strip 15 is directed over the fold portion 23 of the upper guide member 21. Adjustment of the knob 31 allows for changes in border width.

Sheets with curved edges can also be trimmed by the device. Inward or concave radii are also possible because of relief on the device.

The device of this invention will trim thousands of feet of polyethylene/polyester laminating film without becoming dull.

Although various minor modifications may be suggested by those versed in the art, it should be understood that I wish to employ within the scope of the patent granted hereon all such modifications as reasonably and properly come within the scope of my contribution to the art.

I claim as my invention:

1. A lamination trimming device for trimming excess laminating film along edges of a laminated product such that a border of sealed laminating film remains along the product edges, comprising:

(a) lower guide means having a top surface;

(b) upper guide means having a first portion adjacent to the lower guide means top surface and a second portion extending upwardly with respect to the top surface;

(c) cutting means above the first portion of said upper guide means for trimming off the excess film;

(d) said lower guide means including edge guide deflecting means for guiding the device along edges of the laminated product and for deflecting the excess laminated film to be trimmed into trimming contact with said cutting means; and, (e) means connecting and supporting the upper guide means above the lower guide means and supporting the cutting means above the first portion of the upper guide means.

2. The device of claim 1 in which a spacing means is provided comprising said cutting means and a lower surface of the first portion of said upper guide means, said spacing means substantially determining a desired width of the border of sealed laminating film.

3. The device of claim 1 in which said upper guide means first portion comprises a planar portion substantially parallel to the top surface of the lower guide means.

4. The device of claim 1 in which said lower guide means has a planar top surface and said edge guide deflecting means comprises a substantially planar surface having a major portion formed substantially orthogonal to the top surface.

5. The device of claim 4 in which one portion of the edge guide deflecting means is formed less than orthogonal with respect to the top surface.

6. The device of claim 4 in which one portion of the edge guide deflecting means is formed greater than orthogonal with respect to the top surface.

7. The device of claim 1 in which the lower guide means connects to a main body member, the upper guide means connects to a cover member, and the cutting means comprises a blade disposed between the main body member and cover member.

8. The device of claim 7 in which a folded portion means joins the upper guide means to the cover member, said blade being receivable within said folded portion means.

9. A lamination trimming device for trimming excess laminating film along edges of a laminated product such that a border of sealed laminating film remains along the product edges, comprising:

(a) lower guide means having a top surface;

(b) upper guide means having a first portion adjacent to the lower guide means top surface and a second portion extending upwardly with respect to the top surface;

(c) cutting means above the first portion of said upper guide means for trimming off the excess film;

(d) said lower guide means including edge guide deflecting means for guiding the device along edges of the laminated product and for deflecting the excess laminated film to be trimmed into trimming contact with said cutting means;

(e) a folded portion means joining the upper guide means to a cover member, said blade being receivable within said folded portion means;

(f) means provided to permit sliding the blade into the folded portion means, said folded portion means increasing a width of the sealed border remaining on the product after trimming by moving the upper guide means downwardly when the blade slides into the folded portion means; and (g) the lower guide means connecting to a main body member, and the blade being positioned between the cover member and the main body member.

10. The device of claim 7 in which a slidable retaining member is positioned beneath the main body member.

11. The device of claim 10 in which threaded means are provided on the retaining member for receiving a bolt means for compressing the main body member and blade between the retaining member and the cover member.

12. The device of claim 7 in which a transition means is provided for connecting the lower guide means to the main body member, said transition means positioning a portion of said lower guide means adjacent said edge guide deflecting means at a level lower than the main body member.

13. The device of claim 12 in which the transition means positions a top planar surface of the lower guide means at an angle to the main body member.

14. A lamination trimming device for trimming excess laminating film along edges of a laminated product, comprising:

(a) lower guide means;

(b) upper guide means having a first portion substantially parallel to the lower guide means and a second portion formed upwardly of the lower guide means, said lower and upper guide means able to confine said laminated product therebetween;

(c) cutting means above the first portion of said upper guide means for trimming off the excess film;

(d) said lower guide means including edge guide deflecting means for guiding the device along edges of the laminated product and in cooperation with the upper guide means bending the excess laminated film to be trimmed into position for cutting by the cutting means; and, (e) means connecting and supporting the upper guide means above the lower guide means and supporting the cutting means above the first portion of the upper guide means.

15. A lamination cutting device for cutting laminating film along edges of a laminated product such that a border of sealed laminating film remains along the product edges, comprising:

(a) lower guide means;

(b) upper guide means having a first portion adjacent to the lower guide means top surface and a second portion extending upwardly with respect to the top surface;

(c) cutting means above the first portion of said upper guide means for trimming off the excess film;

(d) said lower guide means including edge guide deflecting means for guiding the device along edges of the laminated portion and for deflecting the excess laminated film to be trimmed toward said cutting means and into trimming contact with said cutting means;

(e) said upper guide means first portion spacing the laminated product from the cutting means to provide said border of sealed laminating film; and, (f) and means connecting and supporting the upper guide means above the lower guide means and supporting the cutting means above the first portion of the upper guide means.

* * * * *